United States Patent [19]

Miyakawa et al.

[11] Patent Number: 4,665,303

[45] Date of Patent: May 12, 1987

[54] THERMAL DEVELOPING APPARATUS

[75] Inventors: Tadashi Miyakawa; Yoshiyuki Monma; Yuji Rikiishi; Hideo Seto, all of Kanagawa, Japan

[73] Assignee: Fuji Photo Film Co., Ltd., Kanagawa, Japan

[21] Appl. No.: 796,123

[22] Filed: Nov. 8, 1985

[30] Foreign Application Priority Data

Nov. 9, 1984 [JP] Japan ..... 59-170620[U]
Nov. 9, 1984 [JP] Japan ..... 59-170621[U]

[51] Int. Cl.[4] ..... G03G 15/06

[52] U.S. Cl. ..... 219/216; 219/388; 355/14 FU

[58] Field of Search ..... 219/388, 216, 388 S; 355/3 FU, 14 FU

[56] References Cited

U.S. PATENT DOCUMENTS

| | | | |
|---|---|---|---|
| 3,311,040 | 3/1967 | Ishikawa | 219/388 |
| 3,449,547 | 6/1969 | Goodman | 219/388 |
| 3,478,665 | 11/1969 | Umahashi | 219/388 |
| 3,902,041 | 8/1975 | May | 219/388 |
| 3,980,863 | 9/1976 | Wulz | 219/388 |
| 3,989,926 | 11/1976 | Yoshizawa | 219/388 |
| 4,146,777 | 3/1979 | Wells | 219/388 |
| 4,193,078 | 3/1980 | Esposito | 219/216 |
| 4,317,026 | 2/1982 | Koblo | 219/216 |
| 4,367,037 | 1/1983 | Nishikawa | 355/14 FU |
| 4,548,772 | 10/1985 | Kawamata | 264/DIG. 46 |

FOREIGN PATENT DOCUMENTS

| | | |
|---|---|---|
| 56-1939 | 1/1981 | Japan . |
| 59-75247 | 4/1984 | Japan . |

*Primary Examiner*—E. A. Goldberg
*Assistant Examiner*—Teresa J. Walberg
*Attorney, Agent, or Firm*—Sughrue, Mion, Zinn, Macpeak & Seas

[57] ABSTRACT

A thermal developing apparatus develops thermally a photosensitive material having an electrically conductive, heat-generating layer. The apparatus is provided with a heat-insulating cover which is disposed in contact with or close to the surface of the photosensitive material when supplied with electric current, whereby the generation of convection of air at the upper side of the photosenstive material is prevented, and the occurrence of uneven development is eliminated. When the heat-insulating cover is disposed at a distance away from the surface of the photosensitive material, if this distance is less than a predetermined value, no convection of air takes place and, hence, there is no risk of uneven development occurring.

23 Claims, 6 Drawing Figures

THERMAL DEVELOPING APPARATUS

BACKGROUND OF THE INVENTION

1. Field of the Invention

The present invention relates to a thermal developing apparatus for developing thermally a photosensitive material, the photosensitive material having an electrically conductive, heat-generating layer. More particularly, the present invention pertains to a thermal developing apparatus capable of uniformly heating the photosensitive material when subjected to thermal development.

2. Description of the Related Art

An image recording system which employs a thermally developable photosensitive material (referred to simply as a "photosensitive material", hereinafter) is arranged such that the photosensitive material which has been exposed in an exposing section is transported to a developing section where it is subjected to thermal development, and the developed material is then transported to a subsequent step.

One example of this type of image recording system is disclosed in the specification of Japanese Patent Laid-Open No. 75247/1984. In this system, the exposed photosensitive material is fed to the area between a guide plate and a hot plate and is tightly clamped therebetween for a predetermined period of time so as to be heated for effecting development.

The specification of Japanese Patent Laid-Open No. 1939/1981 discloses a developing means arranged such that an electrically conductive layer is overlaid on a photosensitive material, and electric current is supplied to this layer so as to directly heat the photosensitive material through the layer.

In a thermal developing apparatus for developing a photosensitive material with the above-described electrically conductive material layer (referred to as the "electrically conductive, heat-generating layer", hereinafter), each of the front and rear ends of a sheet of photosensitive material is clamped by a pair of roller groups including an electrode roller, and a voltage is applied between the front and rear ends of the electrically conductive, heat-generating layer through the electrode rollers, thereby developing thermally the photosensitive material.

As the electrically conductive, heat-generating layer heats up and the photosensitive material is thereby heated, a convection is generated in the air surrounding the photosensitive material, so that the heated air rises and separates from the material, and the cold air flows down around it instead. In consequence, the whole surface of the photosensitive material is not uniformly heated, which leads to unevenly developed image.

SUMMARY OF THE INVENTION

In view of the above circumstances, it is a primary object of the present invention to provide a thermal developing apparatus which is capable of substantially preventing the generation of convection of air and thereby uniformly heating a photosensitive material.

To this end, the present invention provides a thermal developing apparatus in which a cover made of a heat-insulating material is disposed in close contact with the upper surface of a photosensitive material when subjected to thermal development.

Since the cover is disposed in close contact with the upper surface of a photosensitive material, no air is present adjacent to the upper surface of the photosensitive material; hence, no convection of air occurs. In addition, since the cover is made of a heat-insulating material, the amount of heat taken away by heat conduction is very small.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

Figure 1:
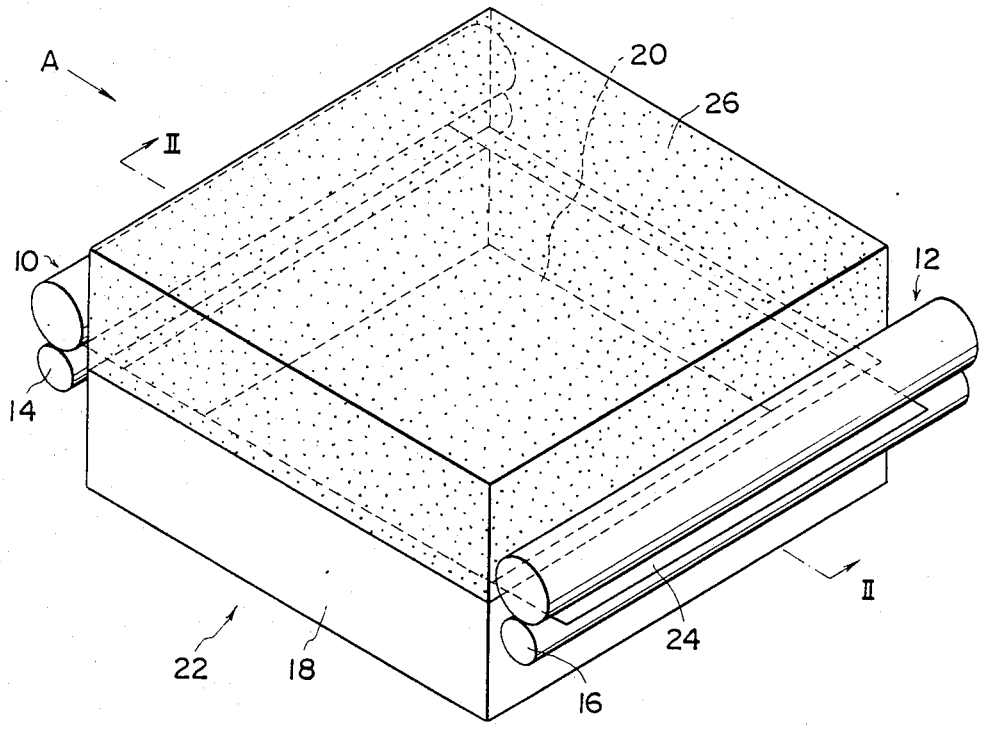
FIG. 1 is a schematic perspective view of a first embodiment of the thermal developing apparatus according to the present invention.
Figure 2:
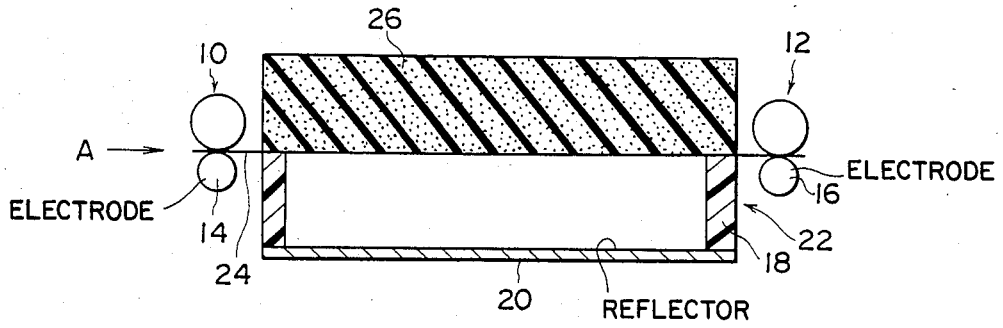
FIG. 2 is a sectional view taken along the line II—II of FIG. 1.

FIGS. 1 and 2 show in combination a first embodiment of the thermal developing apparatus according to the present invention. In this embodiment, each of the upstream- and downstream-side roller groups 10 and 12 is constituted by a pair of upper and lower rollers. The lower rollers in these roller groups 10 and 12 are constituted by electrode rollers 14 and 16, respectively.

A casing 22 is disposed between the upstream- and downstream-side roller groups 10 and 12 so as to extend below the photosensitive material passing line. The casing 22 the upper side of which is open is constituted by a frame 18 and a bottom plate 20. The frame 18 is made of a hard heat-insulating material such as an acrylic resin. The front and rear frame members of the frame 18, which are respectively located at the front and rear ends of the frame 18 in terms of the direction in which a photosensitive material 24 is transported (the direction of the arrow A), are positioned in the vicinities of the upstream- and downstream-side roller groups 10 and 12, respectively. The right and left frame members of the frame 18, which are disposed so as to extend in the photosensitive material transporting direction, are positioned outside the effective exposure area of the photosensitive material 24. The bottom plate 20 is made of a metal and also serves as a reflecting plate.

A cover 26 is made of a soft heat-insulating material such as a sponge material and has a rectangular parallelepiped configuration with such a size that the peripheral portion of the reverse surface of the cover 26 is supported by the frame 18. The cover 26 is mounted on the frame 18 with the photosensitive material 24 interposed therebetween by a manual operation conducted by an operator, or an automatic operation effected by lifting means (not shown).

The following is a description of the operation of this embodiment.

A sheet of photosensitive material 24 which has been exposed in an exposing section (not shown) is transported to the thermal developing apparatus in accordance with this embodiment which serves as a developing section. The leading end portion of the photosensitive material 24 is clamped by the upstream-side roller group 10, and the material 24 is thereby transported toward the downstream-side roller group 12. When the leading end portion of the photosensitive material 24 is clamped by the downstream-side roller group 12, the rotation of the upstream- and downstream-side roller groups 10 and 12 is suspended. In this state, the photosensitive material 24 is positioned above the frame 18, with both ends thereof clamped by the upstream- and downstream-side roller groups 10 and 12, respectively.

Next, the cover 26 is mounted on the photosensitive material 24 so as to be in close contact with the upper surface of the material 24 by a manual operation conducted by the operator, or an automatic operation effected by the lifting means (not shown). Thus, the cover 26 is supported by the frame 18 through the photosensitive material 24 interposed therebetween. Thereafter, a voltage is applied between the electrode rollers 14 and 16 by a power supply (not shown), whereby electric current flows through the electrically conductive, heat-generating layer of the photosensitive material 24, causing the layer to heat up. In consequence, the photosensitive material 24 is heated, and thermal development is started. Since the cover 26 is mounted on the photosensitive material 24 so as to be in close contact with the upper surface of the material 24, there is no space for air to generate a convection at the upper side of the photosensitive material 24.

In addition, the casing 22 is located at the lower side of the photosensitive material 24 so that the air within the casing 22 is enclosed by the material 24. There is therefore no risk of the heated air separating from the periphery of the photosensitive material 24. Further, since the cover 26 and the frame 18 are made of heat-insulating materials, the amount of heat taken away by heat conduction is very small. Since the bottom plate 20 also serves as a reflecting plate, the heat radiated from the photosensitive material 24 is reflected by the plate 20 so as to effectively heat the photosensitive material 24 which has a relatively small heat capacity.

When the thermal development has been completed, the upstream- and downstream-side roller groups 10 and 12 are rotated to transport the photosensitive material 24 to a subsequent step. It is to be noted that the margins of the photosensitive material 24 which are adjacent to the portions respectively abutting against the front and rear frame members of the frame 18 are set such as to be positioned outside the effective exposure range and therefore not subjected to thermal development.

As described above, in this embodiment, the cover 26 made of a sponge material is mounted on the photosensitive material 24 so as to be in close contact with the upper surface thereof; hence, there is no space for air to generate a convection at the upper side of the photosensitive material 24. Accordingly, there is no risk of the photosensitive material 24 being unevenly heated, which would be caused by the convection of air. The degree by which the photosensitive material 24 is unevenly heated by possible convection of air is extremely small at the lower side of the photosensitive material 24 as compared with the upper side thereof. In this embodiment, the casing 22 is disposed at the lower side of the photosensitive material 24 so as to prevent any heated air from dispersing, and the bottom plate 20 is employed so as to serve as a reflecting plate for the purpose of utilizing the reflected heat. Accordingly, it is possible to effect excellent thermal development.

Figure 3:
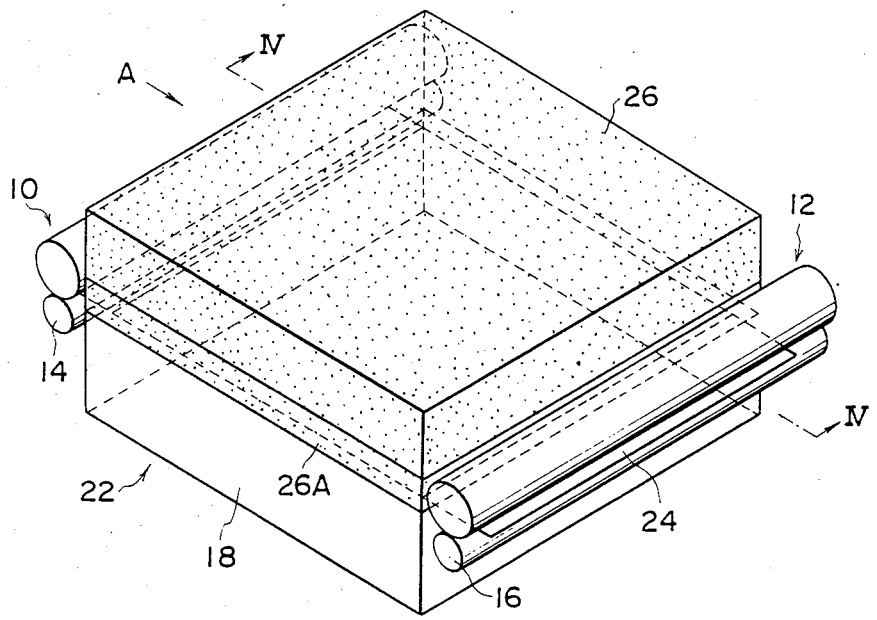
FIG. 3 is a schematic perspective view of a second embodiment of the thermal developing apparatus according to the present invention.
Figure 4:
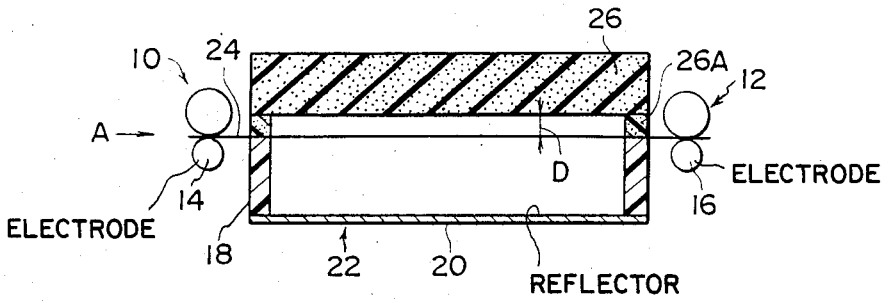
FIG. 4 is a sectional view taken along the line IV—IV of FIG. 3.

A second embodiment of the present invention will be described below with reference to FIGS. 3 and 4.

The cover 26 in this embodiment has a cover frame 26A of a sponge material attached to the peripheral portion of its reverse surface. The cover frame 26A is so shaped that it abuts against and is supported by the upper end of the frame 18.

The distance D between the lower surface of the cover 26 and the upper surface of the photosensitive material 24 is set at about 5 mm. At such a small distance, no convection of air occurs in the space between the cover 26 and the photosensitive material 24.

It has experimentally been confirmed that a convection is generated by the difference between the temperature of a substance with a relatively high temperature and the temperature of a substance located above the high-temperature substance when the distance between these substances exceeds a certain value which varies in accordance with the temperature difference. In the case of this embodiment, the temperature of the electrically conductive, heat-generating layer is about 160° to 170° C. Therefore, if the room temperature is assumed to be 20° C., the temperature difference between the cover 26 and the photosensitive material 24 is about 140° to 150° C. It has been confirmed that, in such a case, the convection of air takes place from the position about 6 mm above the upper surface of the photosensitive material 24. In this case, therefore, the distance D between the upper surface of the photosensitive material 24 and the lower surface of the cover 26 is set such as to be smaller than 6 mm, whereby there is no generation of convection of air which would adversely affect the photosensitive material 24.

Figure 5:
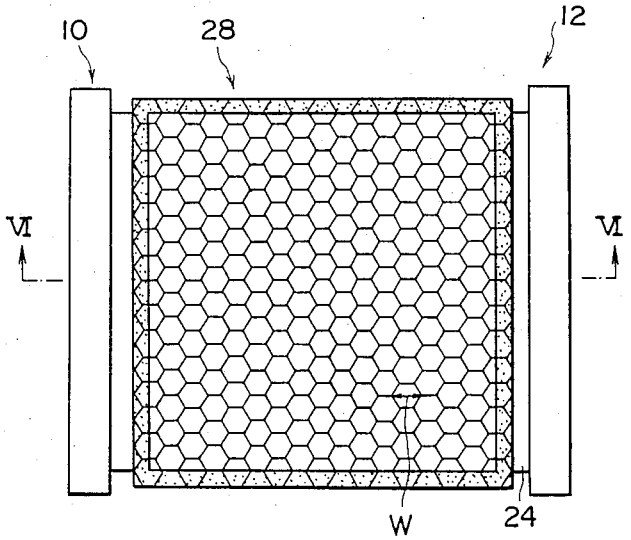
FIG. 5 is a plan view of a third embodiment of the thermal developing apparatus according to the present invention.
Figure 6:
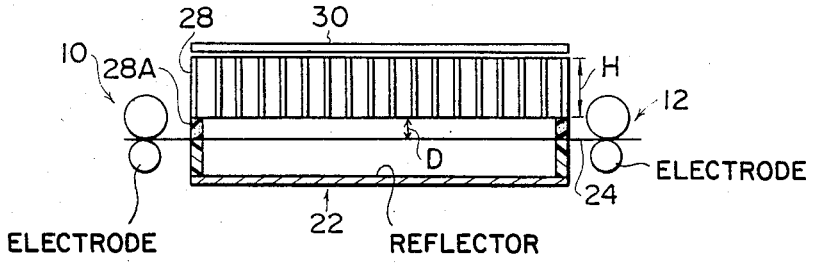
FIG. 6 is a sectional view taken along the line VI—VI of FIG. 5.

FIGS. 5 and 6 show in combination a third embodiment of the thermal developing apparatus according to the present invention. The arrangement of this embodiment is similar to that of the second embodiment except for a cover 28.

The cover 28 is constituted by an aluminum honeycomb structure. The cover 28 has a cover frame 28A of a sponge material attached to the peripheral portion of its reverse surface. The cover frame 28A is so shaped that it abuts against and is supported by the upper end of the frame 18. The distance D between the lower surface of the cover 28 and the upper surface of the photosensitive material 24 is set at about 5 mm in a manner similar to that in the second embodiment. It has experimentally been confirmed that, under the same heating conditions of the electrically conductive, heat-generating layer as those for the second embodiment, the aluminum honeycomb structure involves no risk of air entering the inside of the honeycomb compartments, provided that the maximum diameter or width W of the honeycomb compartments is less than about 5 mm, and the honeycomb structure can therefore serve as a heat-insulating member. It has also experimentally been confirmed that the height H of the honeycomb compartments is preferably set at about 20 to 50 mm.

The cover 28 in this embodiment functions in a manner similar to that of the cover 26 of the second embodiment and has similar advantages. In addition to them, the following advantages are further offered by the cover 28 of the third embodiment. Namely, since it is possible to dispose a reflecting plate 30 above the cover 28, the heat radiated from the photosensitive material 24 can be reflected, so that the heat efficiency is advantageously increased. In addition, the upstream- and downstream-side roller groups 10 and 12 and the air surrounding both the roller groups are forcedly cooled every time the thermal development for a single sheet of photosensitive material 24 is completed, whereby the atmosphere temperature at the time of starting each thermal developing operation is maintained at a constant level. Since it is possible for the air introduced for effecting the cooling to pass through the inside of the honeycomb structure, it is unnecessary to remove the cover 28 for each cooling operation.

What is claimed is:

1. A thermal developing apparatus for developing thermally a photosensitive material, said material having an electrically conductive, heat-generating layer, said apparatus comprising:

(a) means for retaining two end portions of said photosensitive material which means serves as an electrode;

(b) means for heating said retained photosensitive material by applying a voltage to the electrically conductive, heat-generating layer of said photosensitive material through said means (a); and (c) a heat-insulating cover disposed close to or slightly away from an upper surface of said retained photosensitive material so as to cover said photosensitive material, whereby the convection of heated air which occurs at the upper surface of said photosensitive material is suppressed, and occurrence of uneven development is eliminated.

2. A thermal developing apparatus according to claim 1, wherein said heat-insulating cover is brought into contact with the upper surface of said photosensitive material through a frame made of a soft material so that a narrow gap is defined between said cover and said photosensitive material.

3. A thermal developing apparatus according to claim 1, wherein said heat-insulating cover is made of a soft material.

4. A thermal developing apparatus according to claim 1, further comprising a casing disposed at a lower surface of said photosensitive material so that an open side of said casing is close to or in contact with said photosensitive material, thereby eliminating non-uniform distribution of temperature over the lower surface of said photosensitive material.

5. A thermal developing apparatus according to claim 4, wherein a bottom surface of said casing which faces said photosensitive material is constituted by a reflecting plate.

6. A thermal developing apparatus according to claim 5, wherein said retaining means is constituted by a first pair of rollers for clamping a leading end portion of said photosensitive material and a second pair of rollers for clamping a trailing end portion of said photosensitive material, one of each pair of rollers being an electrode roller which constitutes said heating means.

7. A thermal developing apparatus according to claim 6, wherein a distance between said first and second pairs of rollers is larger than a length of said heat-insulating cover.

8. A thermal developing apparatus according to claim 1, wherein said heat-insulating cover is constituted by a honeycomb structure in which compartments of said honeycomb structure extend vertically and have a maximum diameter of 5 mm or less.

9. A thermal developing apparatus according to claim 8, wherein a lower end portion of said honeycomb structure is brought into contact with a lower surface of said photosensitive material through a frame made of a soft material.

10. A thermal developing apparatus according to claim 9, further comprising a reflecting plate provided at an upper side of said honeycomb structure to reflect heat radiated from said photosensitive material.

11. A thermal developing apparatus for developing thermally a photosensitive material, said material having an electrically conductive, heat-generating layer, said apparatus comprising:

(a) a first pair of clamping and transporting rollers for clamping a leading end portion of said photosensitive material;

(b) a second pair of clamping and transporting rollers for clamping a trailing end portion of said photosensitive material;

(c) means for supplying electric current to said photosensitive material in a state wherein the leading and trailing end portions of said material are clamped by the respective pairs of rollers; and (d) a heat-insulating cover disposed in contact with or at a distance of 6 mm or less away from an upper surface of said photosensitive material when supplied with electric current, thereby preventing the generation of convection of air at the upper surface of said photosensitive material.

12. A thermal developing apparatus according to claim 11, wherein said heat-insulating cover is brought into contact with the upper surface of said photosensitive material through a frame made of a soft material so that a narrow gap is defined between said cover and said photosensitive material.

13. A thermal developing apparatus according to claim 11, wherein said heat-insulating cover is made of a soft material.

14. A thermal developing apparatus according to claim 11, further comprising a casing disposed at a lower surface of said photosensitive material so that an open side of said casing is close to or in contact with said photosensitive material, thereby eliminating non-uniform distribution of temperature over the lower surface of said photosensitive material.

15. A thermal developing apparatus according to claim 14, wherein a bottom surface of said casing which faces said photosensitive material is constituted by a reflecting plate.

16. A thermal developing apparatus according to claim 11, wherein a distance between said first and second pairs of rollers is larger than a length of said heat-insulating cover.

17. A thermal developing apparatus according to claim 11, wherein said heat-insulating cover is constituted by a honeycomb structure in which compartments of said honeycomb structure extend vertically and have a maximum diameter of 5 mm or less.

18. A thermal developing apparatus according to claim 17, wherein a lower end portion of said honeycomb structure is brought into contact with the surface of said photosensitive material through a frame made of a soft material.

19. A thermal developing apparatus for developing thermally a photosensitive material, comprising:

(a) a first pair of clamping and transporting rollers for clamping a leading end portion of said photosensitive material;

(b) a second pair of clamping and transporting rollers for clamping a trailing end portion of said photosensitive material;

(c) means for supplying electric current to said photosensitive material through at least one of each of said first and second pairs of clamping and transporting rollers for the purpose of heating said photosensitive material in a state wherein the leading and trailing end portions of said material are respectively clamped by said pairs of rollers; and (d) a heat-insulating cover disposed between said first and second pairs of clamping and transporting rollers so that said cover is in contact with or at a distance of 6 mm or less away from an upper surface of said photosensitive material when supplied with electric current, thereby preventing generation of convection of air at the upper surface of said photosensitive material.

20. A thermal developing apparatus according to claim 19, wherein said heat-insulating cover is brought into contact with the upper surface of said photosensitive material through a frame made of a soft material so that a narrow gap is defined between said cover and said photosensitive material.

21. A thermal developing apparatus according to claim 19, further comprising a casing disposed at a lower surface of said photosensitive material so that an open side of said casing is close to or in contact with said photosensitive material, thereby eliminating non-uniform distribution of temperature over the lower surface of said photosensitive material.

22. A thermal developing apparatus according to claim 19, wherein said heat-insulating cover is constituted by a honeycomb structure in which compartments of said honeycomb structure extend vertically and have a maximum diameter of 5 mm or less.

23. A thermal developing apparatus according to claim 22, wherein a lower end portion of said honeycomb structure is brought into contact with an upper surface of said photosensitive material through a frame made of a soft material.

* * * * *